United States Patent [19]

Lerner et al.

[11] 4,201,029

[45] May 6, 1980

[54] METHOD AND APPARATUS FOR PACKAGING

[75] Inventors: Bernard Lerner, Peninsula; Dana J. Liebhart, Streetsboro, both of Ohio

[73] Assignee: Automated Packaging Systems, Inc., Twinsburg, Ohio

[21] Appl. No.: 933,424

[22] Filed: Aug. 14, 1978

[51] Int. Cl.[2] ..... B65B 5/10

[52] U.S. Cl. ..... 53/429; 53/467; 206/494

[58] Field of Search ..... 53/429, 116, 117, 467; 270/39; 206/494, 820, 554

[56] References Cited

U.S. PATENT DOCUMENTS

| | | | |
|---|---|---|---|
| 3,285,405 | 11/1966 | Wanderer | 206/820 X |
| 3,673,757 | 7/1972 | Willis | 53/429 |
| 3,793,797 | 2/1974 | Roberts et al. | 53/459 |

*Primary Examiner*—Travis S. McGehee

*Attorney, Agent, or Firm*—Watts, Hoffmann, Fisher & Heinke Co.

[57] ABSTRACT

A carton filled with a chain of interconnected open bags arranged in a plicated array is disclosed. A process for filling the carton is disclosed in which the chain of bags is fed into an inverted container, closed end first, with the bags being laid in horizontal layers. Each layer is folded back on the preceding layer to produce a plicated array.

At the completion of carton loading, the trailing edge of the web preferably is fed along one end wall of the container and out an opening near or at what will become the top of the container. The container is then closed and inverted. The first bag in is the first bag out and it is positioned adjacent to a dispensing opening. The last bag in, which will be the last bag out, also projects exteriorly of the carton and is fixed in place as by taping it to the side of the carton.

The plicated array has alternate folds spaced inwardly from the ends of the container.

6 Claims, 2 Drawing Figures

METHOD AND APPARATUS FOR PACKAGING

REFERENCE TO RELEVANT PATENTS AND APPLICATION

1. U.S. Pat. Nos. 3,254,468, "Method of Packaging Articles," 3,298,580, "Container Delivery Apparatus," and 3,455,088, "Container Delivery Apparatus," all issued to Hershey Lerner, here the Autobag Patents.

2. U.S. Pat. Nos. 3,815,318, 3,882,656, 3,956,866 and 4,014,154, each entitled "Packaging Method and Apparatus". U.S. Pat. Nos. 3,948,015 entitled "Packaging System" and 3,965,653 entitled "Packaging Apparatus", here the H-100 Patents.

3. U.S. application Ser. No. 845,114 filed Oct. 25, 1977 by Bernard Lerner and Dana J. Liebhart, entitled "Method and Apparatus for Loading Containers Horizontally", here the Horizontal Machine Patent.

BACKGROUND OF THE INVENTION

1. Field of the Invention

The invention relates to a method and apparatus for transporting and dispensing containers and, more particularly, to a method and apparatus for transporting and dispensing containers in the form of a chain of open bags.

2. The Prior Art

The Autobag Patents disclose a packaging technique in which a chain of interconnected open plastic bags are used. In the earliest and simplest commercial form a roll of these bags was mounted on a mandrel and the mandrel was positioned in a box. A blower was connected to the box. Bags were fed, closed end first, out of a slot in the box. As the bags exited from the box, air from the blower exiting through the same slot as the bags, would inflate each bag as it came out of the box. A product was manually inserted into the inflated bag which was then separated from the chain. The loaded, separated bag was then closed and usually heat sealed.

The dispensing of bags of the type described in the Autobag Patents was initially accomplished with disposable shipping containers that also served as dispensing containers. As a next step in the evolution of eqiupment for effecting packaging with a chain of open bags on a roll, manually controlled dispensing machines were developed. These machines were adapted to receive coils of interconnected open bags. The bags were fed through a dispensing opening in the machine vertically downwardly along a path of travel. In a typical operation an operator would manually insert a product, after a bag had been blown open. The operator would then manually separate the bag from the chain of bags and insert the opening of the now loaded bag into a heat sealer. Concurrently with the separation of the now loaded bag the operator would feed the chain of bags to bring the next succeeding bag into the loading station.

More sophisticated relatively automatic equipment has been developed for loading and sealing chains of open bags on a roll. An example of such equipment is that disclosed and claimed in the H-100 Patents. With that equipment, bags are automatically fed to the loading station. In addition, they are automatically sealed and separated from the chain after products have been loaded in.

More recently, a machine for loading relatively large and bulky objects and relatively sharp objects into bags has been developed. This is the machine which is described and claimed more fully in the Horizontal Machine Patent where, like earlier machines and until the present invention was made, bags on a roll were used. With this machine, a bag being filled is supported in a generally horizontal orientation during loading so that the object being packaged is supported by the machine rather than the web as has generally been the case with other loading machines using bags on a roll.

While both chains of bags on a roll which have been sold under the trademark AUTOBAG and various machines for dispensing those bags have enjoyed outstanding commercial success, there are applications where bags on a roll create problems and indeed even some where they are unsatisfactory.

When a user operates a bag filling machine on a continuous basis, considerable operator attention and skill is required. In some applications, two rolls of bags are positioned side-by-side. The loading operation is started by feeding bags off one of the rolls. As the bags from the first roll are expended, a so-called flying splice is made to connect the first bag of the second roll to the last bag of the first roll. Obviously, the operator must pay attention to the extent to which bags have been expended off the first roll so that he is present and able to move swiftly once the last bag becomes accessible.

After the bags from one roll have been expended, the operator must remove the spent roll and mount another roll with a fresh supply of bags in its place. He must then be prepared to perform another flying splice when the bags from the second roll are expended.

In operations where two rolls and flying splices are not used, the packaging machine must be shut down when bags from a roll are expended. The operator then must remove the spent roll, insert a new roll, and manually feed the chain of bags in the new roll along the dispensing path through the machine. Preferably, he will stop the machine just as the supply of bags in the first roll is being exhausted, change rolls, and effect a splice and then restart the dispensing machine. This preferred technique obviates the need for manual feeding of the new chain along the machine's dispensing path.

Since feed from the roll is intermittent, there can be considerable starting and stopping. Alternately, bags may be fed from the roll continuously at a relatively slow rate and dancer rolls are used to maintain tension on the web section wending its way through the machine to a load station. The length of that web section shortens each time a new bag is fed to the dispensing station and then gradually increases as the bag at that station is loaded and then severed. Obviously, rather precise controls and relatively intricate mechanisms are required to effect this dispensing and the inertia of the rolls can be a problem. Accordingly, the size of a dispensing roll, and therefore the number of bags in a given roll, is limited by the inertia of the roll.

As larger and larger bags have been used in the bags on a roll concept, the problem attendant to manipulating the rolls has intensified and the numbers of bags which may be wound on the roll has reduced. As a consequence, the need to effect flying splices or alternatively to shut down a dispensing machine is more frequent and the efficiency of the overall system is reduced.

SUMMARY OF THE INVENTION

A dispenser made in accordance with the present invention overcomes the foregoing problems and others. In its preferred form, a carton is provided which is filled with a chain of interconnected open bags arranged in a plicated array. A chain of bags is fed into an inverted container, closed end first, with the bags being laid in horizontal layers. Each layer is folded back on the preceding layer.

One aspect of the invention which makes it possible to construct a plicated array which is relatively flat and permits large numbers of bags to be positioned in a container in this manner, is that alternate folds are spaced inwardly from ends of the container of the order of one-fifth of the width of the container. More specifically, and as an example, a first layer is laid along what will become the top of a carton to cover it. A fold is made adjacent the first end wall, and a second layer is laid atop the first. A fold is then made spaced from the second end wall at a location spaced from the end wall a distance of the order of one-fifth the end-to-end length of the carton. A third layer is laid on top of the second and a fold is formed between the third layer and what will become the fourth layer. This fold is at a location spaced from the first wall a distance of the order of one-fifth the total end-to-end length of the carton. A fold at the end of the fourth layer is then made at a location adjacent the second end wall. The fifth layer is then folded adjacent the first wall and the folding sequence is then repeated so that certain folds are adjacent one end, other folds are adjacent the other end, and the remaining folds are spaced inwardly from the certain and other folds.

With a fully loaded carton, the layers are arranged such that folds near each end are alternately adjacent and spaced from the ends. Followed along the web the repetitive sequence is a fold adjacent the first end, one adjacent the second end and then folds spaced from both ends followed by folds adjacent the ends. Thus, traced along the length of the web, the folds are in pairs alternately adjacent and spaced from the ends.

The weight of the bags themselves compresses the layers and folds such that the finished and loaded container has layers which are generally flat and lie essentially horizontally when a container is positioned on a horizontal surface.

At the completion of container loading, the trailing edge of the web preferably is fed along one end wall of the container and out an opening near or at what will become the top. The container is then closed and inverted. The first bag in then becomes the first bag out and it is positioned either adjacent to or projecting from a dispensing opening and may be secured in place. The last bag in which will be the last bag out also projects exteriorly of the container and is fixed in place as by taping it to the side of the container.

In use, the first bag is simply fed into a bag-filling machine. The machine then draws bags from the container as required. The relatively complex feeding machanisms which have been needed in the past with spools of bags are eliminated. In addition, the only tension on the web is from the weight of the bags which are actually being fed and accordingly very simple mechanisms can be used to feed and to transversely locate the chain as compared with the mechanisms used in the past on a tensioned web of bags.

The need for flying splices is eliminated but continuous operation is easily achieved. This is done by positioning a second container adjacent the first and connecting the first bag of the second container to the exposed last bag of the first. As soon as the bags are dispensed from the first container, dispensing of the second container will automatically start without the need for operator attention.

Other major economies are effected. With one size carton and bag it is possible for example to position 3000 bags in a continuous chain in plicated array. That same carton will hold four spools of bags on a roll, each of the order of 300 to 350 bags per roll. Thus, far more bags are provided per shipping carton. In addition, not only are splices made far more easily, they are made far more infrequently since one carton can contain as many bags as several spools. The cost of spools is eliminated A further advantage is that since the cartons are filled, the "shipment of air" is substantially eliminated. Further economies result because far less operator attention and effort is required during bag filling and sealing operations.

Other objects and a fuller understanding of the invention may be had by referring to the following description and claims taken in conjunction with the accompanying drawings.

DESCRIPTION OF THE PREFERRED EMBODIMENT

Figure 1:
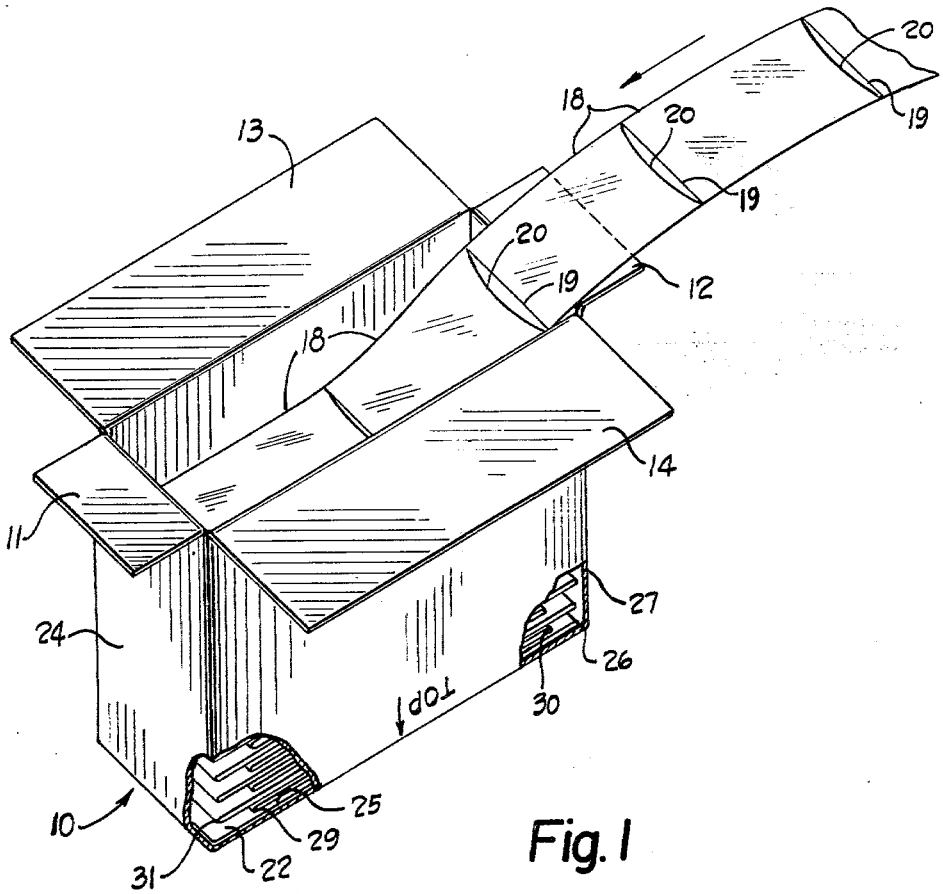
FIG. 1 is a perspective view of an inverted carton being filled with a web in the form of a chain of interconnected open bags; and, FIG. 2 is a perspective view of the carton, with parts broken away and removed, showing the web being fed from the carton to a schematically shown loading and dispensing machine and also showing a fragmentary portion of a second carton.

Referring to the drawings, a six-sided container in the form of a carton is shown generally at 10. In FIG. 1 the carton is shown in an inverted condition with bottom end flaps 11, 12 and side flaps 13, 14 bent outwardly to allow filling access to the carton 10. A web in the form of a chain of open plastic, preferably polyethylene bags is shown generally at 16. The web of bags is preferably of the type described and claimed more fully in the Autobag Patents which are here incorporated by reference.

Each bag 18 has a closed end 19 and is open in one face of its other end as is shown in exaggerated form at 20. The bags are fed into the inverted carton closed end first. The purposes for feeding the bags closed end first are (a) to permit high speed carton loading without the bags inflating and (b) to permit the bags to be fed from the carton to a filling machine closed end first.

During carton loading a first one of the bags 22 is positioned near a first carton end 24 adjacent top 25 of the carton. That first bag 22 is the first bag positioned in the carton and it will be the first bag dispensed from the carton. The first bag 22 constitutes a part of a first layer laid along the top 25 and extending from the first end 24 of the carton to a fold 26 adjacent a second end 27 of the carton. The web is then fed from the second end 27 towards the first end 24, from right to left as viewed in FIG. 1, to a fold at 29 which is spaced from the second end of the carton. The web is then fed left to right to a fold 30 spaced from the second carton end 27 and thence back along a fourth layer of web to a fold 31 adjacent the first end of the carton. Thereafter the web continues to be fed zig-zag fashion, repeating the described fold pattern, until the carton is filled. That is, the folds near each carton end are alternately adjacent to and spaced from the end. Expressed another way, the fold sequence in the web which repeats is adjacent the first and then the second end 24, 27 and then spaced from the first and then the second end.

The purpose of spacing alternate folds inwardly from the carton ends is to overcome a problem attendant to the folding. As the plastic folds, even when weighted, the resultant fold is not a full and complete 180° bend. Rather, the fold tends to have greater thickness than do two adjacent webs toward the center of the carton. Accordingly, absent the novel and improved staggered fold arrangement described here, providing a plicated layer of any substantial depth becomes a practical impossibility because the top of such an array of layers becomes so concave the layers actually fold onto themselves and bags will not feed from a carton properly.

With the staggered fold arrangement described here, a substantially flat arrangement is provided top to bottom in the carton and simple and ready dispensing of the bags, once the carton has been filled, is provided.

Figure 2:
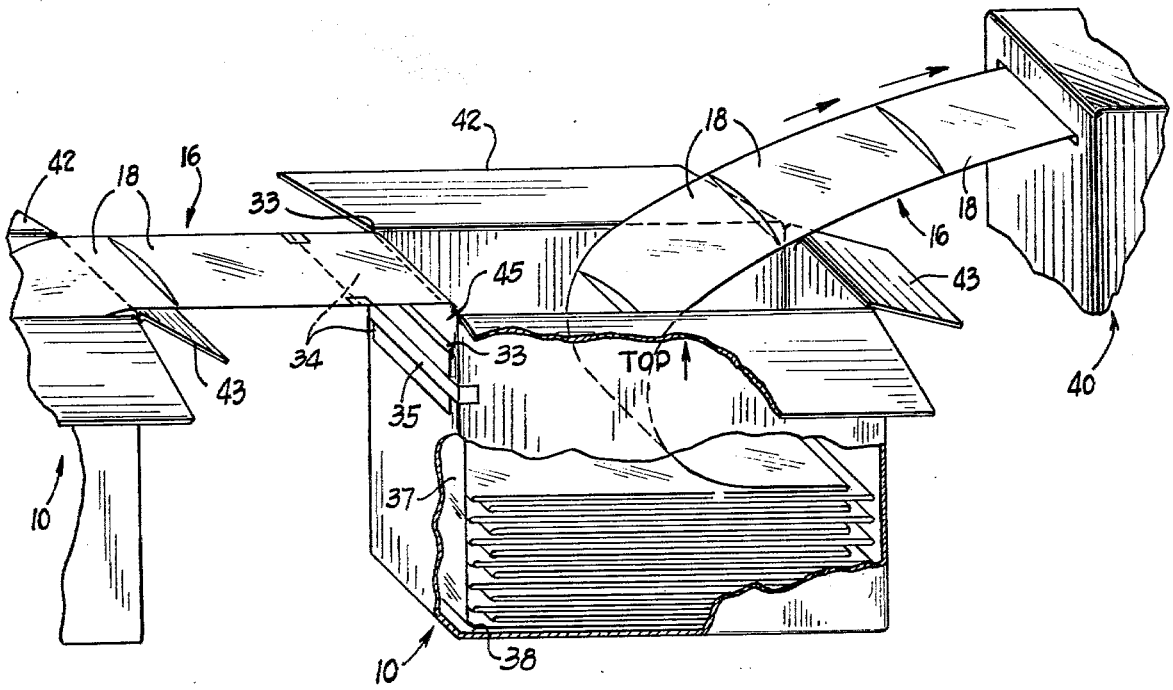

After a carton has been fully filled by developing the plicated array as has been described and as is illustrated in FIG. 1, a last bag of the web is fed along an end of the carton and through a last bag aperture or opening 33, FIG. 2. In FIG. 2, a last bag 34 is shown projecting through the bag aperture 33 and removably secured in place, in its exposed exterior position, by friction tape 35.

In FIG. 2, the carton is broken away to show the web extending from this last bag 34 along a vertical reach to connect with a last fed and bottom layer 38. During the carton loading operation, once the reach 37 and the last bag 34 have been properly positioned, the bottom flaps 11, 14 are closed and sealed in place and the carton is inverted for later transportation to a dispensing station and use.

For clarity of understanding, the relationship of the layers of bags in both FIGS. 1 and 2 are shown as if they were somewhat spaced. This is done to allow proper illustration of the folding pattern, but it should be understood that in actual practice the weight of the plastic itself will compress the plicated array so it is very tightly packed and the carton is substantially filled by the web of connected bags.

Referring now to FIG. 2, a fragmentary and schematic drawing of the packaging machine is shown at 40. The chain of bags 16 is being fed from an upright carton 10, closed end first, to the packaging machine 40. The carton is shown with one side and one end flap 42, 43 open the other end flap and a portion of the other side flap are removed for clarity.

A fragmentary portion of a second and identical carton is also shown in FIG. 2. The second carton is shown as open with its web 16 being fed toward the carton from which bags are being dispensed. The first bag in that web is shown as secured to a phantom showing of the last bag 34 of the dispensing carton. This connection is accomplished by simply loosening or removing the tape 35 to free the last bag from its connection to its carton and then securing the last bag to the first bag of the next web. A carton portion 45 above the last bag aperture 33 should be torn away so that the feed of bags from the second carton need not be through the aperture 33.

Once the bags in the dispensing carton are exhausted, dispensing from the second carton will start automatically and without operator attention. At his convenience, the operator can remove the emptied carton and shift the second carton to the position occupied in the drawing by the dispensing carton. This process can obviously be repeated endlessly to permit continuous production packaging runs.

As has been indicated, the web being fed from the carton is essentially tension free with the only tension of the web being the weight of the bags being fed. Other advantages which have been mentioned should be readily recognizable including the fact that the carton in use is filled essentially completely before shipment, flying splices are not required, and far less operator attention is required during the bag loading operations.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A method of shipping and dispensing a web of interconnected bags each open along one face at its top comprising:

(a) feeding the bags, closed end first, into an inverted carton through an opening near the bottom of the carton;

(b) positioning the web in layers paralleling the top of the carton by feeding the web back and forth zigzag fashion to arrange the web in layers with folds at both ends of each layer;

(c) forming alternate folds near each end of the carton first adjacent to and then spaced from the end to develop a relatively flat plicated array while allowing the weight of the web itself to compress the array;

(d) closing the bottom of the carton once filled;

(e) transporting the carton and its contents to a dispensing station and positioning the carton right side up at the dispensing station; and, (f) dispensing the bags from the top of the carton on a first in, first out, last in, last out basis.

2. The method of claim 1 including the step of feeding the last bag in the web through an opening in that carton and positioning at least partially exteriorly of the carton and then securing the exposed last bag in place.

3. A method of packaging for dispensing a web of interconnected bags each open along one face at its top comprising:

(a) feeding the bags, closed end first, into an inverted carton through an opening near the bottom of the carton;

(b) positioning the web in layers paralleling the top of the carton by feeding the web back and forth zigzag fashion to arrange the web in layers with folds at both ends of each layer;

(c) forming alternate folds at each end of each layer to develop a plicated array; and, (d) feeding a last bag in the web from the bottom along a reach between the array and a wall of the carton and positioning the last bag near the top of the carton.

4. The method of claim 3 including feeding the last bag through an opening in the carton to position the last bag at least partially exteriorly of the carton and securing the exposed last bag in place.

5. A method of shipping and dispensing a web of interconnected bags each open along one face at its top comprising:

(a) feeding the bags, closed end first, into an inverted carton through an opening near the bottom of the carton;

(b) positioning the web in layers paralleling the top of the carton by feeding the web back and forth zig-zag fashion to arrange the web in layers with folds at both ends of each layer;

(c) forming alternate folds at each end of each layer to develop a relatively flat plicated array while allowing the weight of the web itself to compress the array;

(d) closing the bottom of the carton once filled;

(e) transporting the carton and its contents to a dispensing station and positioning the carton right side up at the dispensing station; and, (f) dispensing the bags from the top of the carton on a first in, first out, last in, last out basis.

6. The method of claim 5 including feeding a last bag in the web through an opening near the top of the carton and securing an exterior portion of the exposed last bag in place.

* * * * *